US008454481B2

(12) United States Patent
Strom

(10) Patent No.: US 8,454,481 B2
(45) Date of Patent: Jun. 4, 2013

(54) THROWING HAMMERS

(76) Inventor: Lex Strom, Castle Rock, WA (US)

( * ) Notice: Subject to any disclaimer, the term of this patent is extended or adjusted under 35 U.S.C. 154(b) by 362 days.

(21) Appl. No.: 12/785,390

(22) Filed: May 21, 2010

(65) Prior Publication Data

US 2011/0287898 A1 Nov. 24, 2011

(51) Int. Cl.
*A63B 21/00* (2006.01)

(52) U.S. Cl.
USPC ..... 482/88; 473/576

(58) Field of Classification Search
USPC ..... 482/88; 473/576
See application file for complete search history.

(56) References Cited

U.S. PATENT DOCUMENTS

| | | | | |
|---|---|---|---|---|
| 503,387 | A * | 8/1893 | Schofield | 473/576 |
| 1,122,157 | A * | 12/1914 | Reach | 482/20 |
| 2,186,016 | A * | 1/1940 | Evans | 482/88 |
| 6,971,963 | B2 * | 12/2005 | Abel | 473/508 |

OTHER PUBLICATIONS

Track & Field News, Mar. 2001, p. 1, Track & Field News, Mountain View, CA, USA.
Gill Athletics, Gill Soft Hammer, John Godina Signature Series, accessed website at http://www.gillathletics.com/store/product.aspx?id=673 on Mar. 16, 2011.
On Track and Field, The Connolly Hammer Trainer 3, accessed website at http://www.ontrackandfield.com/main/catalog/2011/index.html on Mar. 16, 2011.

* cited by examiner

*Primary Examiner* — Jerome W Donnelly
(74) *Attorney, Agent, or Firm* — Mohr Intellectual Property Law Solutions, PC

(57) ABSTRACT

Throwing hammers including a handle, a cable having a first end and a second end opposite the first end, the cable being coupled to the handle at the first end, a swivel fastener coupled to the elongate tension bearing member at the second end, and an elongate tension bearing member of predetermined mass coupled to the swivel fastener at a plurality of intermediate points along the elongate tension bearing member to define a plurality of loops extending from the swivel fastener.

20 Claims, 3 Drawing Sheets

THROWING HAMMERS

BACKGROUND

The present disclosure relates generally to throwing hammers. In particular, throwing hammers with weight dispersing features are described herein.

Known throwing hammers are not entirely satisfactory for the range of applications in which they are employed. For example, existing throwing hammers can unacceptably damage the ground upon landing after being thrown, especially when the ground is wet and/or soft. When thrown typical distances, the concentrated mass of conventional throwing hammers causes them to burrow into the ground upon landing, which creates holes and furrows. These holes and furrows are expensive to repair, represent safety hazards in the form of twisted ankles, and can render fields unusable.

In addition, conventional throwing hammers are insufficiently rugged. Athletes, especially athletes new to the sport of hammer throw, sometimes accidently throw their hammers into rigid supports, such as fences, cages, or posts, that surround the athlete for spectator safety. Substantial impact forces are involved when a throwing hammer impacts a rigid object. Conventional throwing hammers are insufficiently tough and rugged to withstand these impact forces without becoming damaged and/or degraded.

Thus, there exists a need for throwing hammers that improve upon and advance the design of known throwing hammers. Examples of new and useful throwing hammers relevant to the needs existing in the field are discussed below.

SUMMARY

The present disclosure is directed to throwing hammers including a handle, a cable having a first end and a second end opposite the first end, the cable being coupled to the handle at the first end, a swivel fastener coupled to the elongate tension bearing member at the second end, and an elongate tension bearing member of predetermined mass coupled to the swivel fastener at a plurality of intermediate points along the elongate tension bearing member to define a plurality of loops extending from the swivel fastener.

DETAILED DESCRIPTION

The disclosed throwing hammers will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, numerous examples of throwing hammers are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously.

Figure 1:
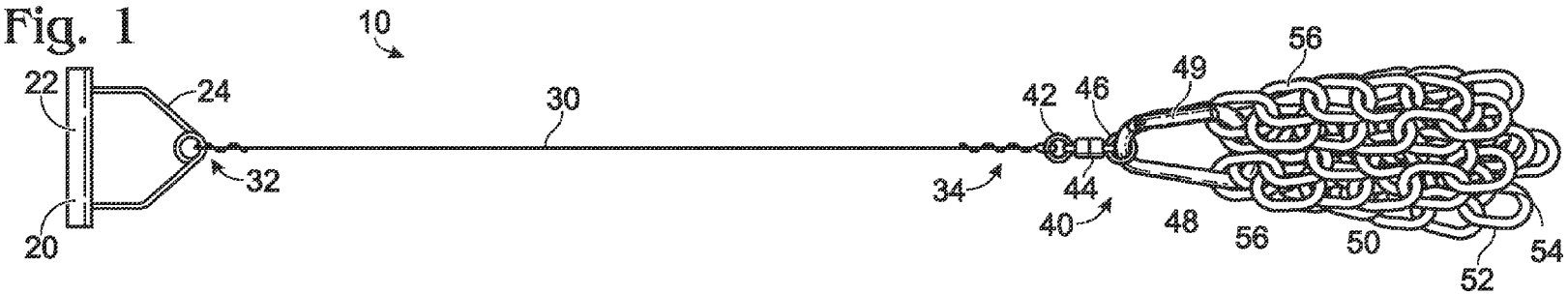
FIG. 1 is a side elevation view of a first example of a throwing hammer in a compact position.

With reference to FIG. 1, a throwing hammer 10 includes a handle 20, a cable 30, a swivel fastener 40, and an elongate tension bearing member 50. Throwing hammer 10 is used to practice and compete in the hammer throw track-and-field sport. Throwing hammer 10 may be used for both competitions and training.

Figure 3:
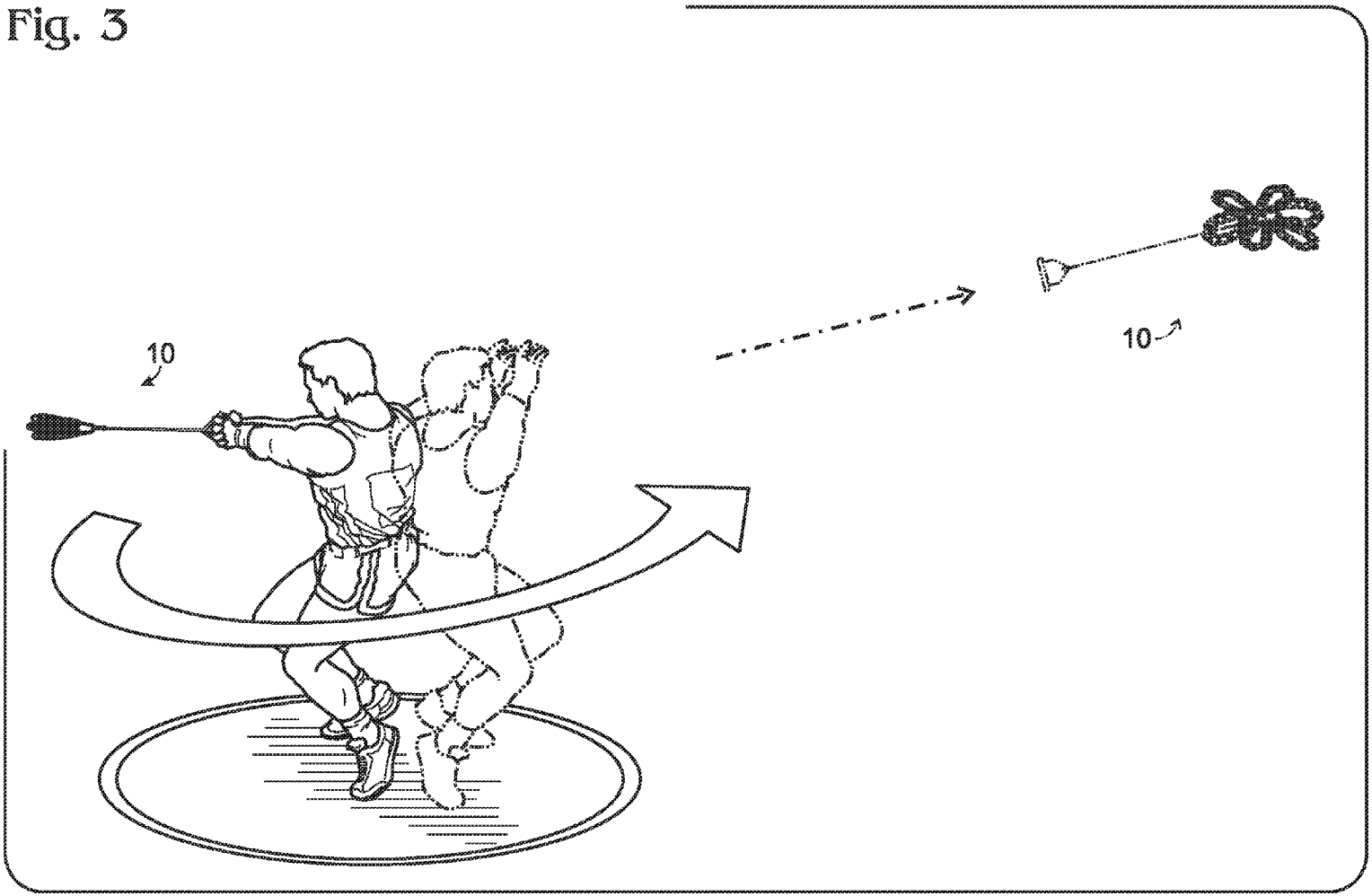
FIG. 3 is a perspective view of an athlete throwing the throwing hammer shown in FIG. 1.

As depicted in FIG. 3, throwing hammer 10 adopts a compact position, shown in solid lines, when rotated by an athlete and adopts a dispersed position, shown in dashed lines, in flight after being released by the athlete. The throwing hammer remains in the dispersed position upon landing to reduce or eliminate damage to the ground. The compact position mimics the concentrated mass properties and feel of a conventional throwing hammer.

Figure 4:
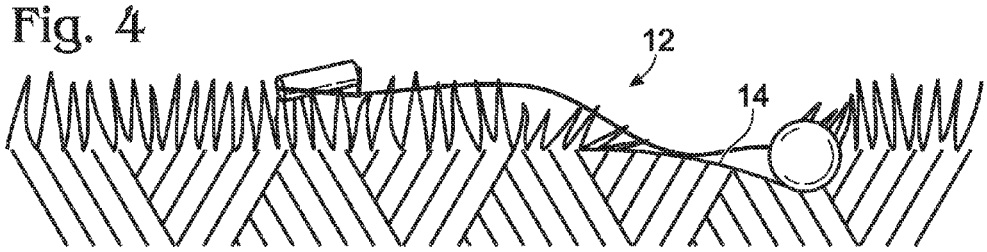
FIG. 4 is side elevation view of a cross section of a grass field onto which a conventional throwing hammer has come to rest after being thrown by an athlete.

As shown in FIG. 4, a conventional hammer 12 can cause considerable damage to the ground upon landing on the ground. FIG. 4 depicts a furrow or divot 14 created in the ground by the landing impact force resulting from the significant mass, velocity, and momentum of a conventional throwing hammer when thrown by an athlete. Wet field conditions can exacerbate the damage caused by a conventional hammer because the ground becomes softer and less capable of resisting impact forces when wet.

Figure 5:
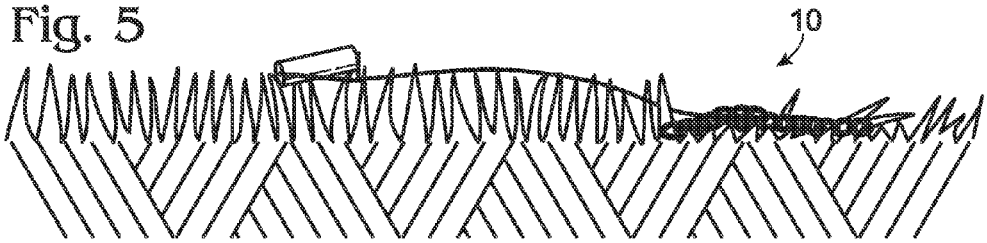
FIG. 5 is side elevation view of a cross section of a grass field onto which the throwing hammer shown in FIG. 1 has come to rest after being thrown by an athlete.

In contrast, FIG. 5 depicts a lack of damage to the ground in the area where throwing hammer 10 has landed. The weight dispersing features of throwing hammer 10, which will be described in more detail below, disperse the impact force of throwing hammer 10 over a wider area of ground. As the reader will readily appreciate, spreading out the impact force of throwing hammer 10 subjects each unit area of ground where the hammer lands to less impact force. The reduced force upon impact reduces or eliminates damage to the ground.

Handle 20 facilitates the athletes manipulation and use of throwing hammer 10. Any handle design suitable for use with a throwing hammer may be used. In the example shown in the figures, handle 20 is a conventional metal throwing hammer handle.

Figure 2:
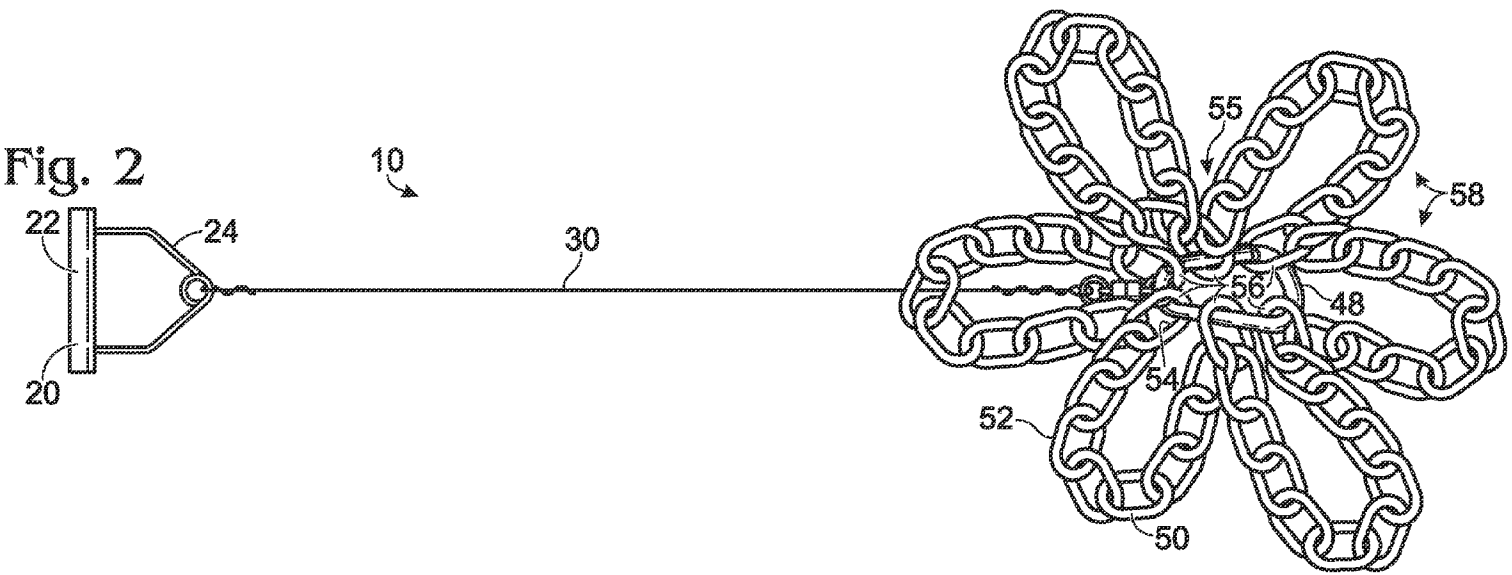
FIG. 2 is a side elevation view of the throwing hammer shown in FIG. 1 in a dispersed position.

More particularly, handle 20 includes a handgrip 22 and a handle member 24. As can be seen in FIGS. 1 and 2, handle member 24 extends from a first end of handgrip 22 to a second end of handgrip 22 opposite the first end along a bent path. The bent path defines a handle ring at the apex of the bent path. Handgrip 22 and handle member 24 collectively define a loop providing unobstructed space for the athletes hands to grip handgrip 22.

In this particular example, cable 30 is an elongate high tensile strength metal wire with a diameter of 3 millimeters. Cable 30 is resilient to bending along its length. Cable 30 may be any suitable elongate tension bearing member.

Figure 6:
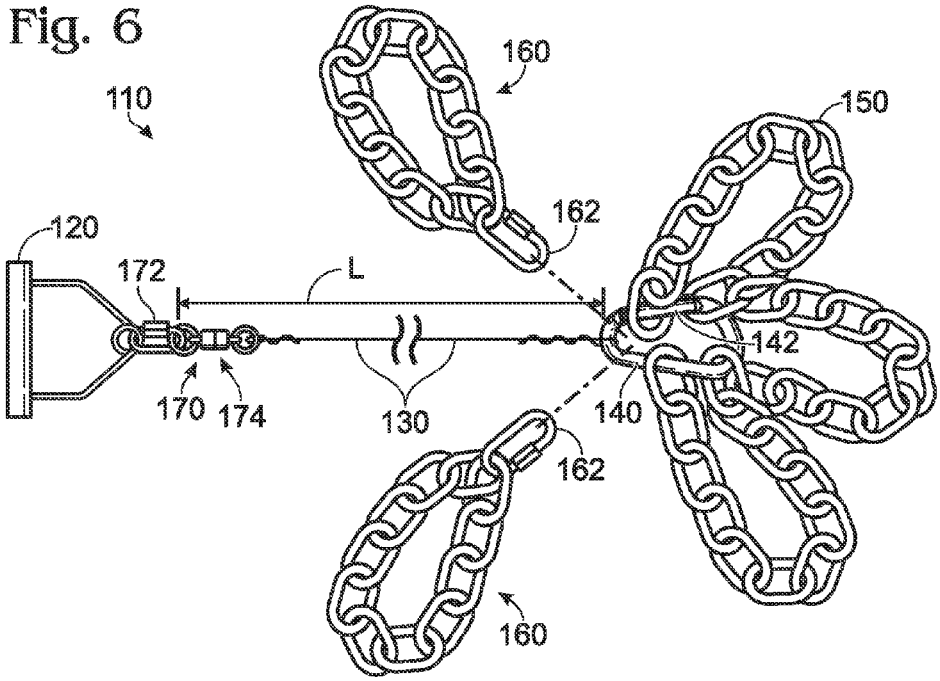
FIG. 6 is a side elevation view of a second example of a throwing hammer, which is configured for selective addition and removal of mass units.

The length of cable 30 may be selected to be longer, shorter, or substantially equivalent to the length of a cable in a traditional throwing hammer. With reference to FIG. 6, it can be seen that a length L of cable 130 may be selected to be a desired length.

As shown in FIGS. 1 and 2, cable 30 includes a first cable end 32 and a second cable end 34. First cable end 32 couples to handle member 24 at the handle ring defined by the bent path distal handgrip 22. In this particular example, first cable end 32 is wrapped upon itself to define a loop that remains intact under tension.

Cable 30 couples to handle member 24 by extending first cable end 32 into the handle ring and then wrapping first cable end 32 upon itself to lock it in place. Any known coupling technique or device may be used to couple cable 30 to handle 20. In some examples, the throwing hammer includes fasteners, clamps, hooks, carabineer clips, cleats and the like to couple the handle to the cable.

In the example shown in FIGS. 1 and 2, swivel fastener 40 includes a first ring 42, a bearing 44, a second ring 46 opposite bearing 44 from first ring 42, and a third ring 48 coupled to second ring 46. Cable 30 couples to first ring 42 and elongate tension bearing member 50 couples to third ring 48.

In this particular example, third ring 48 is a carabineer clip including a pivoting gate or latch 49. In other examples, the third ring forms a solid ring of material. In still other examples, the third ring defines an opening or gap and includes a latch to selectively cover the gap. In examples with a gap and a latch, the elongate tension bearing member may be selectively coupled and removed from the third ring.

The particular configuration of the swivel fastener shown in FIGS. 1 and 2 is not used in all examples. For instance, in some examples the swivel fastener does not include a third ring, but instead the elongate tension bearing member couples to the second ring. In other examples, a fastener that is not configured to swivel is used. In still other examples, the elongate tension bearing member couples directly to the cable, such as in a loop formed by the second end of the cable.

Bearing 44 enables second ring 46 to rotate relative to first ring 42. This in turn enables third ring 48 coupled to elongate tension bearing member 50 to rotate relative to first ring 42. Rotation about bearing 44 is useful for reducing the tendency of cable 30 to twist in response to movement of elongate tension bearing member 50.

Twisting of cable 30 has been observed to adversely affect the throwing characteristics of throwing hammers as well as adversely affecting the feel of the throwing hammer to the athlete. If the feel of a given throwing hammer is not closely similar to the feel of a traditional throwing hammer, the athlete's throwing technique may suffer. Further, it is preferable that a given throwing hammer closely mimic the properties of a traditional throwing hammer, except for a traditional throwing hammer, the athlete's throwing technique may suffer. Further, it is preferable that a given throwing hammer closely mimic the properties of a tranditional throwing hammer, except for a traditional throwing hammer's tendency to cause turf damage, when used in competition.

Swivel fastener 40 couples to cable 30 by extending second cable end 34 into first ring 42 and then wrapping second cable end 34 upon itself to lock it in place. Any known coupling technique or device may be used to couple cable 30 to swivel fastener 40. In some examples, the throwing hammer includes fasteners, clamps, hooks, carabineer clips, cleats and the like to couple the swivel fastener to the cable.

Elongate tension bearing member 50 shown in FIGS. 1-4 is a chain including a plurality of serially interlinked links 52, which each define link openings 54. In other examples, the elongate tension bearing member is not a chain, but includes cordage, rubber, or fabric. Any material suitable for supporting tension and capable of being formed into an elongate member may be used. Links 52 may be a wide variety of lengths, thicknesses, and mass.

In the example shown in FIGS. 1-4, elongate tension bearing member 50 is selected to have a fixed or predetermined mass. The fixed mass may be described as a certified mass to denote that the fixed mass is certified to be of a certain mass for training and competition validity purposes. In contrast to a fixed or certified mass, a throwing hammer 110 is shown in FIG. 6 that is configured for adjusting the mass of the throwing hammer by addition or removal of mass units 160.

In some examples, the elongate tension bearing member may be selected to have a mass equivalent to a preselected target mass. For instance, the elongate tension bearing member may be selected to have a fixed mass that brings the total mass of the fastener and elongate tension bearing member in combination to be substantially equal to a preselected target mass. In still further examples, the elongate tension bearing member is selected to have a fixed mass that brings the total mass of the throwing hammer to be substantially equal to a preselected target mass.

The preselected target mass may be the mass of a traditional throwing hammer used in a given competition category. A sampling of present competition categories include grade school, junior high, high school, collegiate, and Olympic throwing hammer categories. One or more of the competition categories may be further subdivided by gender with men and women using throwing hammers of different mass.

In other examples, the preselected target mass is heavier or lighter than the mass of a traditional training hammer. A relatively heavy elongate tension bearing member may be useful for increasing an athlete's strength while a relatively lighter elongate tension bearing member may be useful for increasing an athlete's speed, improving his technique, or allowing his bodies to recover from the toll of prior physical activity.

Elongate tension bearing member or chain 50 couples to swivel fastener 40 by extending third ring 48 through link openings 54 of a collection of links 52 to interlock chain 50 to swivel fastener 40 at a central region 55. In the example shown in FIGS. 1-4, the plurality of links 52 define preselected attachment points or preselected links 56 for coupling to third ring 48. As shown in FIGS. 1 and 2, preselected links 56 are spaced from each other a predetermined number of links along the chain to form chain loops 58 having a predetermined mass.

In some examples, the preselected links or preselected attachment points are spaced an equal distance along the length of the elongate tension bearing to define loops of substantially equal mass when the elongate tension bearing member is coupled to the swivel fastener. For example, the preselected links may be spaced an equal or regular number of links apart to define loops having the same number of links. In the example shown in FIGS. 1 and 2, the loops each have twelve (12) links.

However, in other examples, the preselected attachment points or preselected links are different or irregular distances apart to define loops having different mass. For example, the preselected links an irregular number of links apart from each other to define loops with different numbers of links. Loops of different mass may be selected to modify the flight characteristics of the throwing hammer from the characteristics of a throwing hammer with loops of substantially equal mass.

Turning attention to FIG. 6, a throwing hammer 110 will now be described as a second example. Throwing hammer 110 includes certain similar features to throwing hammer 10 that are arranged in unique and distinct ways. Thus, for the sake of brevity, each feature of throwing hammer 110 will not be redundantly explained.

As can be seen in FIG. 6, throwing hammer 110 includes a handle 120, a cable 130, a fastener 140, a elongate tension bearing member 150, mass units 160, and a fastener assembly 170. Throwing hammer 110 is configured for user adjustment of its mass by selectively coupling to and/or removing mass units 160 from throwing hammer 110.

Through adding and removing mass units 160, the athlete can adjust the training properties of throwing hammer 110. For example, the athlete can increase strength by adding mass units 160 and can improve speed and throwing technique by removing mass units 160. Through addition and removal of mass units 160, a single throwing hammer 110 may be used in throwing hammer competitions requiring throwing hammers of different mass.

In the example shown in FIG. 6, handle 120 couples to cable 130 via fastener assembly 170. Fastener assembly 170 includes a coupling ring 172 and a swivel fastener 174. Swivel fastener 174 includes a first ring, a bearing, and a second ring. Coupling ring 172 defines a gap and includes a latch for selectively closing the gap.

In the example shown in FIG. 6, fastener 140 defines a ring defining a gap. The gap may receive mass units 160 or elongate tension bearing member 150. As shown in FIG. 6, fastener 140 includes a pivoting latch 142 for selectively exposing or closing the gap defined by fastener 140.

The FIG. 6 mass units 160 include a clip 162 and an elongate tension bearing member 164. Clip 162 enables mass unit 160 to selectively couple to fastener 140. In other examples, the fastener includes one or more clips for securing mass units. In some examples, elongate tension bearing member 164 couples directly to fastener 140.

In the example shown in FIG. 6, elongate tension bearing member 164 is a chain including a plurality of links of known mass. In some examples, mass units 160 include weights or other objects that are not elongate in shape. Typically, mass units 160 will have a mass smaller than the mass of elongate tension bearing member 150, such as $\frac{1}{4}^{th}$-$\frac{1}{20}^{th}$ the mass of elongate tension bearing member 150. In one example, the throwing hammer has a base weight of 14 pounds and includes two removable mass units weighing 2 pounds and one removable mass unit weight 1 pound.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A throwing hammer, comprising:
a handle;
a cable having a first end and a second end opposite the first end, the cable being coupled to the handle at the first end;
a swivel fastener coupled to the cable at the second end; and
an elongate tension bearing member of predetermined mass coupled to the swivel fastener at a plurality of intermediate points along the elongate tension bearing member to define a plurality of loops extending from the swivel fastener.

2. The throwing hammer of claim 1, wherein the swivel fastener includes a bearing and a ring coupled to the bearing, the cable being coupled to the bearing and the elongate tension bearing member being coupled to the ring.

3. The throwing hammer of claim 2, wherein the ring defines a gap through which the elongate tension bearing member extends into the ring.

4. The throwing hammer of claim 3, wherein the ring includes a latch to selectively cover the gap for restricting the elongate tension bearing member from entering or exiting the ring.

5. The throwing hammer of claim 2, wherein the ring defines a continuous loop.

6. The throwing hammer claim 1, wherein the elongate tension bearing member consists of a chain including a plurality of links defining link openings.

7. The throwing hammer of claim 6, wherein the swivel fastener extends through the link openings of preselected links in the plurality of links to interlock the chain to the swivel fastener.

8. The throwing hammer of claim 7, wherein the preselected links are spaced from each other a predetermined number of links along the chain to form chain loops having a predetermined mass.

9. The throwing hammer of claim 1, wherein the cable is a resilient metal wire.

10. The throwing hammer of claim 9, wherein the second end of the cable is wrapped upon itself to define a loop for coupling to the swivel faster.

11. The throwing hammer of claim 1, wherein the elongate tension bearing member includes preselected attachment points and the swivel fastener couples to the elongate tension bearing member at the preselected attachment points.

12. The throwing hammer of claim 11, wherein the preselected attachment points are spaced an equal distance along the length of the elongate tension hearing member to define loops of substantially equal mass.

13. A throwing hammer, comprising:
a handle;
a cable extending from the handle;
a fastener configured to swivel and coupled to the cable;
a chain including a plurality of serially interlinked links, wherein preselected links of the chain are coupled to the fastener to define loops.

14. The throwing hammer of claim 13, wherein the preselected links are a regular number of links apart from each other to define loops each having the same number of links.

15. The throwing hammer of claim 13, wherein the preselected links are an irregular number of links apart from each other to define loops with different numbers of links.

16. The throwing hammer of claim 13, wherein the chain is selected to have a mass that brings the total mass of the fastener and the chain in combination to be substantially equal to a preselected target mass.

17. The throwing hammer of claim 16, wherein the target mass is equivalent to the mass of a conventional throwing hammer used in track-and-field competitions.

18. The throwing hammer of claim 16, wherein the target mass exceeds to the mass of a conventional throwing hammer used in track-and-field competitions.

19. A throwing hammer, comprising:

an elongate tension bearing member defining loops of pre-selected mass, wherein the loops each extend out from a central region;

a swivel fastener coupled to the loops of the elongate tension bearing member at the central region; and a handle operatively connected to the swivel fastener.

20. The throwing hammer of claim 19, wherein the elongate tension bearing member consists of a chain formed of a plurality of serially interconnected links.

* * * * *